US007500486B2

(12) United States Patent
Gilg

(10) Patent No.: US 7,500,486 B2
(45) Date of Patent: Mar. 10, 2009

(54) FINGERNAIL SANDER

(76) Inventor: Kevin J. Gilg, 154 Danville St., Cantonment, FL (US) 32533

( * ) Notice: Subject to any disclaimer, the term of this patent is extended or adjusted under 35 U.S.C. 154(b) by 0 days.

(21) Appl. No.: 11/705,170

(22) Filed: Feb. 12, 2007

(65) Prior Publication Data

US 2008/0194188 A1 Aug. 14, 2008

(51) Int. Cl.
*A45D 29/18* (2006.01)

(52) U.S. Cl. ..... 132/76.4; 132/73.6; 132/75.8; 451/195; 451/352

(58) Field of Classification Search ..... 451/195, 451/352, 361, 449, 451, 459; 132/76.4, 73.6, 132/75.8
See application file for complete search history.

(56) References Cited

U.S. PATENT DOCUMENTS

| | | | | | |
|---|---|---|---|---|---|
| 1,482,927 | A | | 2/1924 | Buck | |
| 1,562,110 | A | | 11/1925 | Mash | |
| 1,604,720 | A | * | 10/1926 | Pflantzer | 132/75.8 |
| 1,666,619 | A | | 4/1928 | Eberhardt | |
| 1,709,591 | A | * | 4/1929 | Newbound | 132/73.6 |
| 1,915,305 | A | | 6/1933 | Gallagher | |
| 2,056,379 | A | | 10/1936 | Acocella | |
| 2,152,352 | A | * | 3/1939 | Holt | 451/359 |
| 2,258,012 | A | * | 10/1941 | Jeannotte | 132/75.8 |
| 2,389,665 | A | | 11/1945 | Harris | |
| 2,597,525 | A | | 5/1952 | Kessler | |
| 2,923,303 | A | | 2/1960 | Hundt | |
| 3,157,009 | A | * | 11/1964 | Barkley | 451/456 |
| 3,216,034 | A | | 11/1965 | Johnson | |
| 3,255,766 | A | | 6/1966 | Hartwell et al. | |
| 3,311,117 | A | | 3/1967 | Thompson | |
| 3,596,667 | A | | 8/1971 | Buercklin | |
| 3,754,556 | A | | 8/1973 | Watkins | |
| 4,016,890 | A | | 4/1977 | Fiorenza, Sr. et al. | |
| 4,117,854 | A | * | 10/1978 | Rosenbloom | 132/75.8 |
| 4,137,926 | A | | 2/1979 | Pao | |
| 4,683,897 | A | | 8/1987 | McBride | |
| 4,753,253 | A | | 6/1988 | Hutson | |
| 4,799,336 | A | * | 1/1989 | Yang | 451/241 |
| 4,854,334 | A | | 8/1989 | Su | |
| D312,327 | S | | 11/1990 | DeRosier | |
| 5,090,159 | A | * | 2/1992 | Patterson | 451/124 |
| 5,123,430 | A | * | 6/1992 | Davidovitz | 132/75.8 |
| 5,161,552 | A | | 11/1992 | Kathuria | |
| 5,218,787 | A | * | 6/1993 | Rice | 451/229 |
| D347,087 | S | | 5/1994 | Griffin | |
| 5,525,095 | A | * | 6/1996 | Baughman | 451/72 |

(Continued)

*Primary Examiner*—Maurina Rachuba
(74) *Attorney, Agent, or Firm*—Peter Loffler

(57) ABSTRACT

A fingernail grinder uses a bench grinder-like configuration wherein a motor has dual output shafts with a wheel with an abrasive outer circumference attached to one of the shafts. The wheel is contained within a protective housing that has a longitudinal slit through which a fingernail passes to be ground down by the abrasive wheel. A padded member may surround the slit in order to help the user control the depth of insertion of the fingernail. At least one additional slit can be provided with a padded member of different thickness. The opposite side of the device can have a second abrasive wheel with a different coarseness, a buffing wheel or a centrifugal fan contained within a fan housing and having a debris collection bag near the bottom thereof. The fan housing is connected to the abrasive wheel housing and draws the fingernail debris out of that housing and deposits the debris in the debris bag.

18 Claims, 2 Drawing Sheets

U.S. PATENT DOCUMENTS 5,864,746 A 1/1999 Chang
5,887,598 A 3/1999 Oliver et al.
6,848,985 B2 * 2/2005 Lamprecht et al. ..... 451/453
6,865,812 B1 3/2005 Martin, Jr.
2004/0248507 A1 * 12/2004 Brazell et al. ..... 451/361
2007/0089686 A1 * 4/2007 Drelinger ..... 119/609

* cited by examiner

FINGERNAIL SANDER

BACKGROUND OF THE INVENTION

1. Field of the Invention

The present invention relates to device that uses a rotating wheel having an abrasive outer circumference that grinds down a person's fingernails.

2. Background of the Prior Art

Many people need to be well groomed in their calling in order to provide a professional and hygienic appearance to their clients. Workers in the food industry, salespeople, and dental and medical workers, are all examples of professionals that need to employ and maintain proper grooming habits. Additionally, many people, such as those going on a date, or those going on a job interview, want to look good and neatly groomed in order to provide a good impression.

One aspect of overall good grooming is the need to keep fingernails neat and trimmed. No one wants a waiter with dirty fingernails delivering their steak dinner. To achieve neat and trimmed fingernails, many people employ either a small pair of trimming scissors or, more typically, a pair of fingernail clippers that clip the nails in order to keep the fingernails trim and clean. This simple ritual is performed countless times each day to keep fingernails trim and free of debris that can accumulate underneath untrimmed nails. However, the process is not without its problems. Many people need to let their fingernails grow to a certain length before trimming them because if trimming shorter nails is attempted, a painful cut below the desired cut line may be experienced. As anyone who has cut themselves in this fashion can attest, such a cut remains painful for an extended period of time. This problem is especially acute when attempting to trim the nails on the dominate hand using the non-dominant hand. As a result, many people must allow their nails to be worn somewhat long before being able to trim them properly and with minimal risk of pain.

Some people overcome such problems by having their nails manicured. A manicurist takes tender loving care of a person's fingernails and makes them look great. While highly effective for great looking nails, going to a manicurist is both expensive and time-consuming and is a luxury that is not practical for most.

As a result, devices have been proposed that allow a person to be able to trim his or her nails irrespective of how long the nails are. Such devices, which come in a wide variety of architectures and effectiveness levels, allow a person to keep nails trimmed on a more frequent basis than can be practically achieved using standard nail clippers or scissors. However, some such devices are unduly complex in design and construction making them unnecessarily expensive and cost-prohibitive for the average consumer. Other devices have the potential to cause injury to the user if the device is not used precisely as specified. To solve this particular problem, some devices operate at a speed that is too slow to be considered practical by many people. Still other devices rely on good manual dexterity for their proper use so that a user can experience the problem of properly trimming nails on the dominant hand while operating the device with the non-dominant hand.

What is needed is a nail trimming device that is of relatively simple design and construction so that it is not overly expensive so that the device is readily affordable for a large segment of the marketplace for such devices. The device must have safeguards in place in order to minimize the potential for injury. The device must operate at such a level so as to be considered sufficiently fast by a large segment of the users of such devices. The device should be sufficiently ambidextrous in operation so that a similar nail trim can be achieved on both hands of a user even if such a user has very skewed dominance in his or her hands' dexterity levels.

SUMMARY OF THE INVENTION

The fingernail sander of the present invention addresses the aforementioned needs in the art by providing a nail trimming device that is of relatively simple design and construction, allowing the device to be built using standard manufacturing techniques, making the fingernail sander relatively inexpensive and thus readily affordable for a large segment of the marketplace for these types of devices. The fingernail sander has safeguards in place that are designed to minimize the potential for injury. The fingernail sander operates at a sufficiently fast and acceptable level in its nail trimming function. The fingernail sander is operated in an ambidextrous fashion so that a similar nail trim can be achieved on either hand of a user even if such a user has very skewed dominance in his or her hands' dexterity levels.

The finger nail sander of the present invention is comprised of a motor housing having a motor located therein, the motor having a first output shaft and a second output shaft. A wheel housing is attached to the motor housing and has a first slit that is disposed parallel to the longitudinal axis of the first output shaft of the motor. A wheel having an abrasive outer circumference (abrasive wheel, rubber wheel with abrasive surface (such as sandpaper) removably attached thereto, etc.,), is attached to the first output shaft and is disposed within the wheel housing. A fan housing may be attached to the motor housing, on a side opposite the side to which the wheel housing is attached. A collection bag is removably attached to an exhaust port located on the fan housing. A manifold establishes air flow communication between the wheel housing and the fan housing. A centrifugal fan is attached to the second output shaft and is disposed within the fan housing. Alternate debris collection architectures can also be used. The motor housing is attached to a swivel base. A handle is swivelly attached to the wheel housing (or to the fan housing). A first padded member encompasses the first slit. A rest extends outwardly from the wheel housing just below the first slit. A vacuum relief valve is located on the manifold. At least one second slit may be disposed within the wheel housing, such that the second slit is oriented parallel with the first slit. A second padded member encompasses each second slit such that each second padded member has a different thickness relative to the thickness of the first padded member.

BRIEF DESCRIPTION OF THE DRAWINGS

Similar reference numerals refer to similar parts throughout the several views of the drawings.

DESCRIPTION OF THE PREFERRED EMBODIMENT

Figure 1:
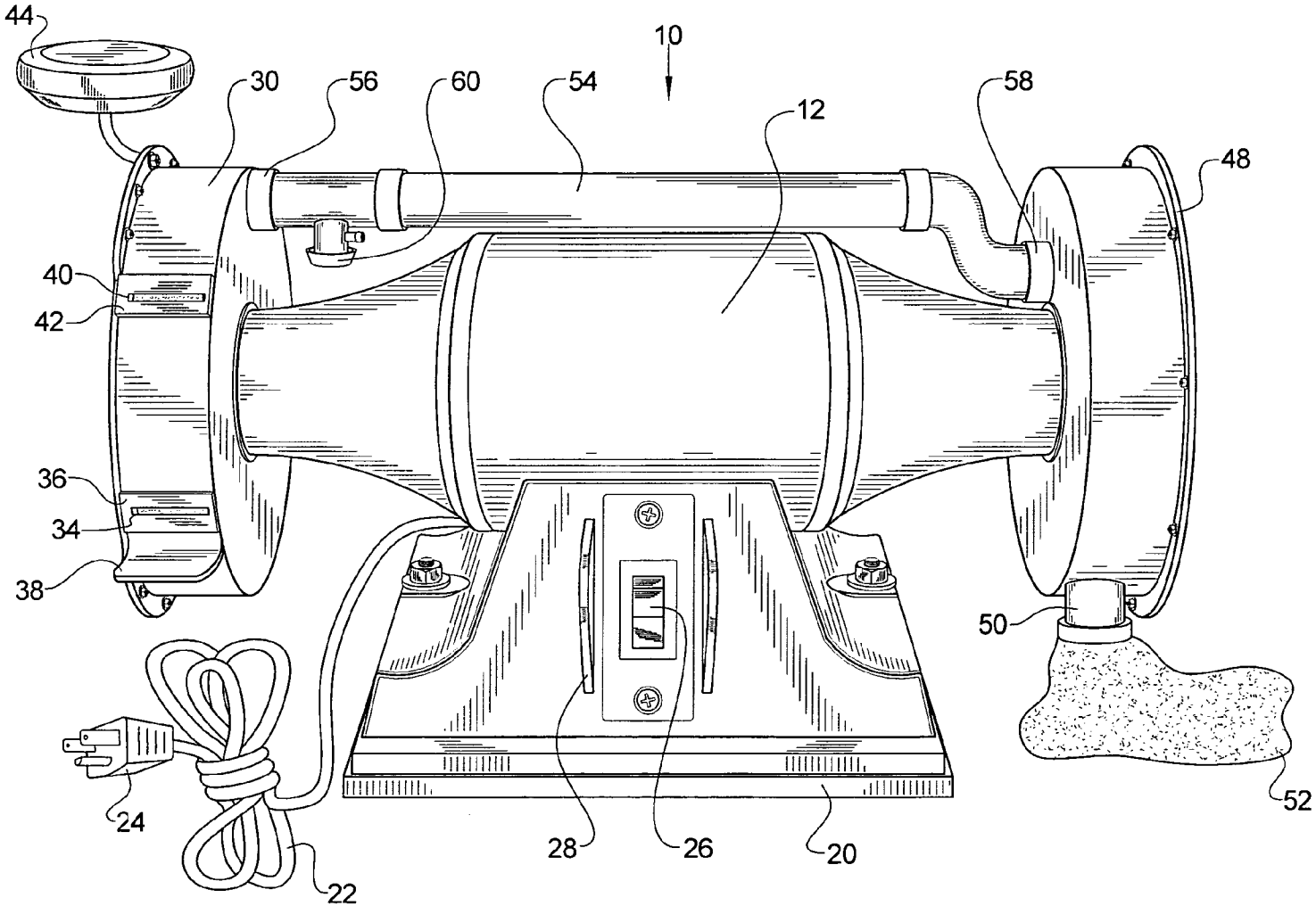
FIG. 1 is a perspective view of the fingernail sander of the present invention.
Figure 2:
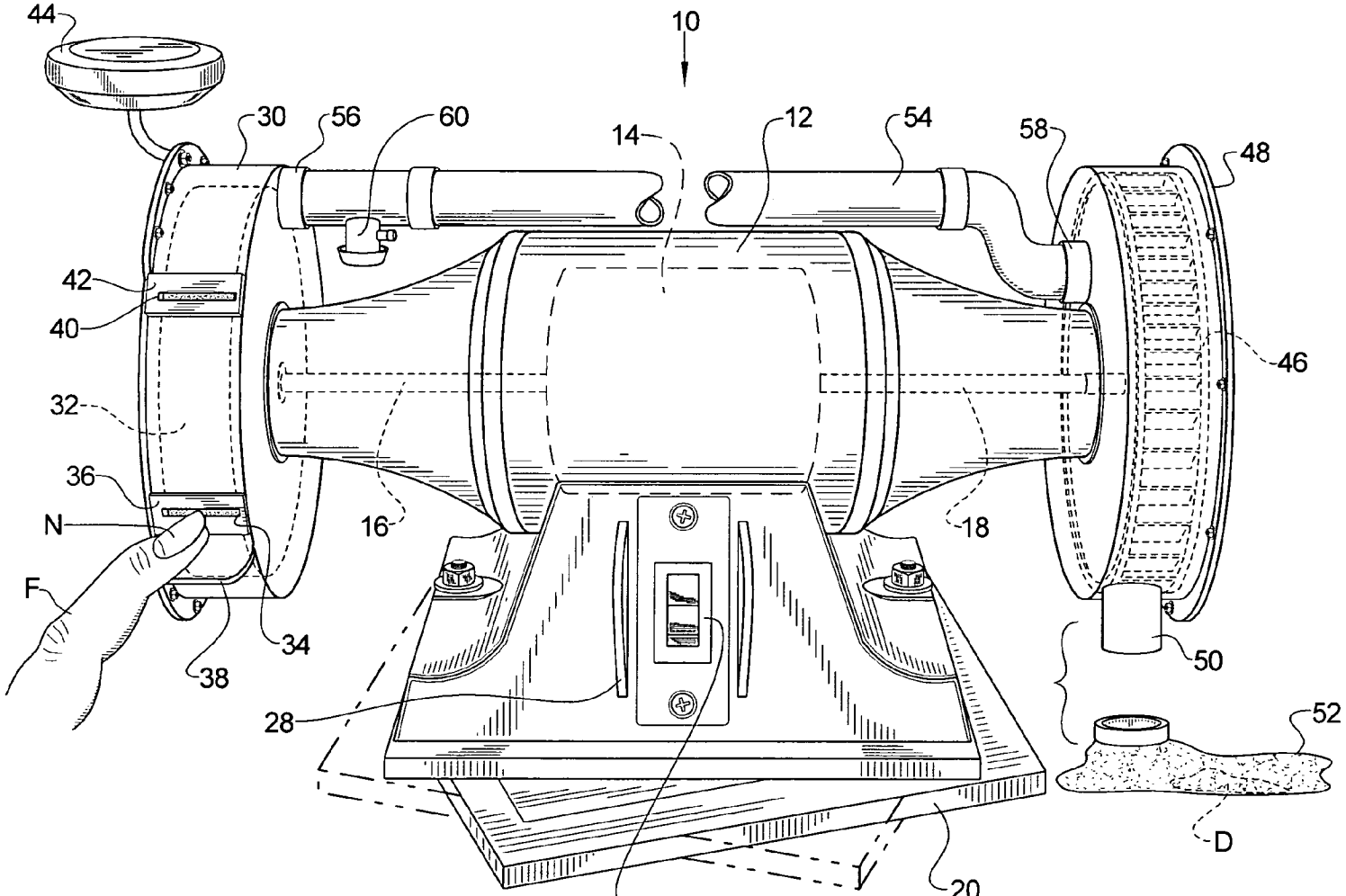
FIG. 2 is a perspective view of the fingernail sander illustrating the vacuum and the swivel base features.

Referring now to the drawings, it is seen that the fingernail sander of the present invention, generally denoted by reference numeral 10, is comprised of main housing 12 that has a motor 14 therein, the motor 14 having a first output shaft 16 and a second output shaft 18. The main housing 12 sits atop a swivel base 20, which is sits atop and is optionally attached to a desired surface such as a table top, the optional attachment being in any appropriate fashion, the swivel base 20 allowing the main housing 12 to be swiveled either clockwise or counterclockwise. The motor 14 within the main housing 12 receives operational power from a standard cord 22 and plug 24 that is plugged into a typical wall socket (not illustrated). A switch 26 controls operation of the motor 14 within the main housing 12 such that when the plug 24 is plugged in to a source of electrical power, and the switch 26 is placed into the on position, the motor 14 begins operation and rotates the output shafts 16 and 18 (of course, a dual switch configuration can be used wherein the rotational operation of each shaft 16 and 18 is independently controlled so that only one side of the device 10 need be operational at a time). The switch 26 is protected by a typical switch guard 28.

Located on one end of the main housing 12 is a wheel housing 30. Located within the wheel housing 30 is a wheel 32 that is operationally connected to the motor 14 such that when the motor 14 is operational, the wheel 32 rotates via the first shaft 16. The wheel 32, which is sufficiently wide, has an outer circumference that has an abrasive surface thereon. This can be accomplished by having the wheel be an abrasive wheel which setup is similar to a standard bench grinder except that the wheel 32 is enclosed within the wheel housing 30 so as to prevent contact with the wheel 32 by a user in any other fashion except as described below. Alternately, the wheel 32 can be a rubber or similar material wheel that has an abrasive surface (such as a strip of sand paper) attached thereto, as is well known in the art. This type of setup allows a user to swap out the sandpaper strip in order to change the abrasiveness level of the device 10. Other types of abrasive setups can be used.

As seen a first slit 34 is located on the wheel housing 30 which first slit 34 is parallel to the longitudinal axis of the wheel 32. Encompassing the first slit 34 is a first resilient padded member 36 made from rubber, sponge, or the like and which may be removably attached thereto in order to accommodate different lengths and thicknesses of fingernails N that can be serviced by the present invention 10. A finger rest 38 extends outwardly from the wheel housing 30 just below the first slit 34. A second slit 40 may be located on the wheel housing 30 which second slit 40 is parallel to the first slit 34. Encompassing the second slit 40 is a second resilient padded member 42 also made from rubber, sponge, or the like and which padded member 42 may also be removably attached thereto in order to accommodate different lengths and thicknesses of fingernails N that can be serviced by the present invention 10. The second padded member 42 is of a different thickness relative to the thickness of the first padded member 36. A second finger rest (not illustrated) may be located just below the second slit 40. Additional slits with accompanying padded members may also be provided. A handle 44 of any appropriate design is swivelly attached to the wheel housing 30.

The above is the basic design of the fingernail grinder 10. In operation, plug 24 is plugged into an outlet and the motor 14 is activated via the switch 26 causing the wheel 32 to begin rotating in much the same fashion as an ordinary bench grinder operates. A user places a finger F proximate one of the slits 34 or 40, resting the finger F on the finger rest 38 of provided, and inserts the fingernail N into the slit 34 or 40 until the fingernail N makes contact with the abrasive outer circumference of rotating wheel 32. The wheel 32 grinds the fingernail N down to the desired length. The user can rotate the device back and forth across the fingernail N by rotating the entire device 10, which is sitting atop the swivel base 20 using the handle 44 due to its swivel capability which allows flexing and extending of the wrists for thumbnails and adduction and abduction of the hand for fingernails. The slits 34 and 40 are sufficiently narrow, which narrowness can be achieved by the slits 34 and 40 themselves or achieved via the removable padded members 36 and 42 respectively, so as to prevent the user's finger F from passing into the slit and thus into the grinding chamber, thereby helping prevent injury. The padded members 36 and 42, which may provide proper slit 34 and 40 respectively width, help the user control the depth of insertion of the fingernail N into the respective slit 34 or 40. If a user desires a deep insertion, the user presses on the padded member 36 or 42 in order to push deeper into the respective slit 34 or 40. By having two slits 34 and 40 each with a padded member 36 and 42 respectively of different thicknesses allows a user to closely grind on the sides of the nail N and to accommodate longer lengths of fingernails N. Initially, the user with a relatively long fingernail N uses the slit 34 or 40 with the least thick padded member 36 or 42 respectively. This allows the user's fingernail N greater insertion into the grinding chamber allowing the wheel 32 to grind off a substantial amount of the sides of the fingernail N. Once the major grinding of the sides of the fingernail N is complete, the user switches to the other slit 40 or 34 that has a thicker padded member 42 or 36 respectively. The thicker padded member 42 or 36 allows less penetration into the grinding chamber and thus less contact of the fingernail N with the abrasive wheel 32 allowing for a grinding of a relatively longer fingernail N. Once the fingernail N is ground to the desired level, the process is repeated for subsequent fingers F until all desired fingers F have their nails N ground as desired. Thereafter, the motor 14 is switched off by the switch 26.

As the motor 14 has dual output shafts 16 and 18, as is common on typical bench grinders, the other side of the device 10 can be substantially similar to the side described above except that a wheel 32 having an outer circumference of a different coarseness can be used (this configuration not illustrated). In such a configuration, a user begins the grinding process on the side with a relatively coarse abrasive wheel 32 and finishes the fingernail N on the opposite side, the one with a relatively fine abrasive wheel 32. Alternately, a buffing wheel can be located on this other side which wheel (not illustrated) has a felt or similar surface on its outer circumference, which surface allows a person to buff the fingernails N upon completion of the grinding process.

As a further alternative and as illustrated in the drawings, the opposite side may be used for debris collection. In such a configuration, the side opposite the side with the wheel 32 has, instead of another abrasive wheel or buffing wheel, a centrifugal fan 46 attached to the second shaft 18, the centrifugal fan 46 held within a fan housing 48. A fan exhaust 50 is located near the bottom of the fan housing 48 to which a debris bag 52 is removably attached. A vacuum manifold 54 is connected between an outlet port 56 located on the wheel housing 30 and an inlet port 58 located on the fan housing 48. As the fan housing 48 is sufficiently airtight, for safety a vacuum relief valve 60 is located on the manifold 54. In operation, when the motor 14 is activated, the wheel 32 begins rotation for grinding fingernails N as described above. Simultaneously, the centrifugal fan 46 also begins rotating, in response to second shaft 18 rotation, thereby creating a vacuum, which vacuum draws the debris D created by the wheel 32 grinding fingernails N out of the wheel housing 30, through the manifold 54, with the debris D collecting in the debris bag 52. Once the debris bag 52 is full, it is removed from the fan housing 48 and emptied and replaced or a new debris bag 52 is placed onto the fan housing 48.

Alternately, and especially if a buffing wheel is used, debris D collection can be achieved by using a simple collection bag or pan at the bottom of the grinding chamber wherein the debris D gravitationally collects in such a compartment. Of course, still other debris collection methods can be employed in keeping within the scope and spirit of the present invention While the invention has been particularly shown and described with reference to an embodiment thereof, it will be appreciated by those skilled in the art that various changes in form and detail may be made without departing from the spirit and scope of the invention.

I claim:

1. A grinder comprising:

a motor housing;

a motor, located within the motor housing, the motor having an output shaft;

a wheel housing attached to the motor housing, the wheel housing having a first slit that is disposed parallel to the longitudinal axis of the output shaft;

a padded member encompassing the first slit; and a wheel, having an outer circumference with an abrasive surface, attached to the output shaft and disposed within the wheel housing.

2. The grinder as in claim 1 wherein the motor housing is attached to a swivel base.

3. The grinder as in claim 2 further comprising a handle swivelly attached to the wheel housing.

4. The grinder as in claim 1 further comprising a rest extending outwardly from the wheel housing below the first slit.

5. The grinder as in claim 1 further comprising a second slit disposed within the wheel housing, the second slit parallel with the first slit.

6. The grinder as in claim 5 wherein the motor housing is attached to a swivel base.

7. The grinder as in claim 6 further comprising a handle swivelly attached to the wheel housing.

8. The grinder as in claim 5 further comprising a second padded member encompassing the second slit, the second padded member having a different thickness relative to the thickness of the first padded member.

9. The grinder as in claim 5 further comprising a rest extending outwardly from the wheel housing below the first slit.

10. A grinder comprising:

a motor housing;

a motor, located within the motor housing, the motor having a first output shaft and a second output shaft;

a wheel housing attached to the motor housing, the wheel housing having a first slit that is disposed parallel to the longitudinal axis of the first output shaft;

a padded member encompassing the first slit;

a wheel, having an outer circumference with an abrasive surface, attached to the output shaft and disposed within the wheel housing;

a fan housing attached to the motor housing, on a side opposite the side to which the wheel housing is attached;

a collection bag attached to an exhaust port located on the fan housing;

a manifold establishing air flow communication between the wheel housing and the fan housing; and a centrifugal fan attached to the second output shaft and disposed within the fan housing.

11. The grinder as in claim 10 wherein the motor housing is attached to a swivel base.

12. The grinder as in claim 11 further comprising a handle swivelly attached to the wheel housing.

13. The grinder as in claim 10 further comprising a rest extending outwardly from the wheel housing below the first slit.

14. The grinder as in claim 10 further comprising a vacuum relief valve located on the manifold.

15. The grinder as in claim 10 further comprising a second slit disposed within the wheel housing, the second slit parallel with the first slit

16. The grinder as in claim 15 wherein the motor housing is attached to a swivel base.

17. The grinder as in claim 16 further comprising a handle swivelly attached to the wheel housing.

18. The grinder as in claim 15 further comprising a second padded member encompassing the second slit the second padded member having a different thickness relative to the thickness of the first padded member.

* * * * *